US007992740B2

(12) United States Patent
Kinchen

(10) Patent No.: US 7,992,740 B2
(45) Date of Patent: Aug. 9, 2011

(54) OBJECT-SUPPORTING DEVICE ENGAGEABLE WITH A WASTE CONTAINER

(76) Inventor: Frank Kinchen, Tickfaw, LA (US)

( * ) Notice: Subject to any disclaimer, the term of this patent is extended or adjusted under 35 U.S.C. 154(b) by 580 days.

(21) Appl. No.: 12/079,094

(22) Filed: Mar. 25, 2008

(65) Prior Publication Data

US 2009/0242558 A1 Oct. 1, 2009

(51) Int. Cl.
*B65D 51/00* (2006.01)

(52) U.S. Cl. ..... 220/200; 220/908

(58) Field of Classification Search ..... 220/200, 220/908, 574, 575, 571, 694, 633, 630, 628, 220/636, 606, 521
See application file for complete search history.

(56) References Cited

U.S. PATENT DOCUMENTS

| | | | | | |
|---|---|---|---|---|---|
| 651,884 | A * | 6/1900 | Platz | 220/606 |
| 1,510,710 | A * | 10/1924 | Sperling | 211/70.7 |
| 2,262,204 | A * | 11/1941 | Rideout | 220/771 |
| 2,683,579 | A * | 7/1954 | Wallace | 248/146 |
| 3,756,462 | A * | 9/1973 | Cain | 220/23.83 |
| 5,065,891 | A * | 11/1991 | Casey | 220/495.08 |
| 5,207,743 | A * | 5/1993 | Costarella et al. | 220/574 |
| 5,372,274 | A * | 12/1994 | Freedland | 220/571 |
| 7,428,864 | B2 * | 9/2008 | Wengrovsky | 99/646 C |

* cited by examiner

*Primary Examiner* — Robin A. Hylton
(74) *Attorney, Agent, or Firm* — Keaty Law Firm LLC

(57) ABSTRACT

A waste receptacle cover is configured for placing above an open top waste container. The cover has a main body that received objects therein and a central opening for disposal of the waste into the waste container. A tubular guard surrounds the central opening and prevents the objects from dropping into the waste container, while allowing the user to dispose of the waste directly into the waste container.

19 Claims, 3 Drawing Sheets

OBJECT-SUPPORTING DEVICE ENGAGEABLE WITH A WASTE CONTAINER

BACKGROUND OF THE INVENTION

This invention relates to receptacle cover devices adapted for directing waste generated during meals into a receptacle, on which the cover is mounted.

It is often the case in many circumstances that there is a need for disposal of waste that people generate during meals in an environmentally sound manner. Such occasions may be present on a picnic, on a beach, and in a multitude of other places where waste disposal devices are not readily available.

For example, consumption of seafood, such as crustaceans, often results in generation of large amounts of empty shells that should be disposed of without scattering the shells all over the area where the seafood is consumed. Additionally, seafood parties, such as crawfish boils and the like necessarily present a problem of liquid that is drenched from the cooked seafood. This liquid often ends up on the ground, where it attracts insects and makes the area unsanitary.

There have been a variety of table devices developed for use during meal consumptions. However, these devices are not intended for use over a receptacle, such as a trash can, nor do they extend the usable surfaces for the consumers. There are also a variety of decorative trash can covers, but these devices do not provide additional eating space while allowing unhampered access to the interior of the receptacle for waste disposal.

The present invention contemplates elimination of the drawbacks associated with the prior art and provision of a receptacle cover device that can be positioned over a receptacle for collection of waste generated during meals.

SUMMARY OF THE INVENTION

It is therefore an object of the present invention to provide a receptacle cover device that can be position over a waste receptacle for collection of waste generated during meals.

It is another object of the present invention to provide a receptacle cover device that can be easily disassembled and washed when required.

These and other objects of the invention are achieved through a provision of a receptacle cover device which is adapted for supporting objects above an open-top waste container while facilitating disposal of waste within the waste container. The cover device comprises an upright support member configured for positioning in an open top of a waste receptacle and a main body engageable with the support member for substantially covering said open top of the waste receptacle. The main body comprises a bottom with a central opening for providing access to the interior of the waste container, said central opening is surrounded by an upwardly extending guard member for preventing objects supported by the main body from moving through the central opening into the waste receptacle.

The cover has a bottom plate, to which the guard member is secured. A plurality of smaller openings are formed in the bottom plate to allow the liquid to seep into the waste container while the food items rest in the "cup" formed by the main body.

The main body has a rim with a planar top, which can support cups, condiment bottles, napkins or any other objects required in a user's activity.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
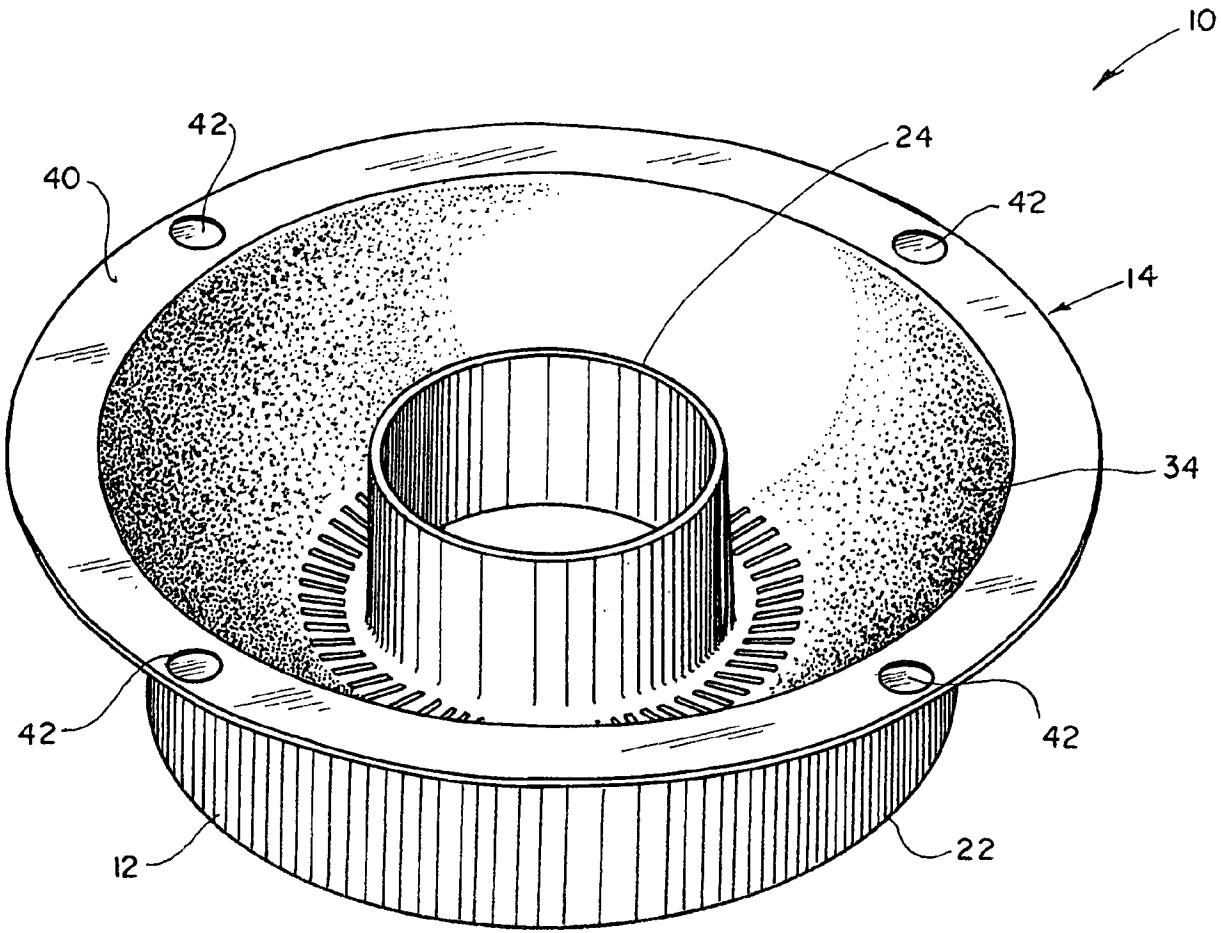
FIG. 1 is a perspective view of the receptacle cover device in accordance with the present invention.

Turning now to the drawings in more detail, numeral 10 designated the cover device of the present invention. As can be seen in the drawings, the cover device comprises a generally tubular upright support member 12 which supports a table-like main body 14 for supporting objects above a waste container 20 while providing access to the interior of the waste container 20 for facilitating disposal of waste within the waste container 20 without disturbing the supported objects. The main body 14 is adapted for generally horizontal positioning over the waste container 20.

The main body 14 is provided with a bottom plate 26 that has an opening 16 extending through the bottom plate 26 and communicating with a through opening 18 formed in the support member 12. In one aspect, the support member 12 has an open bottom 22, which allows disposed objects to drop, by gravity into a waste container 20. The opening 16 is surrounded by a substantially tubular guard member 24 which extends from the bottom 26 of the main body upwardly. In one aspect the guard member 24 extends to a vertical level of a top rim 30 of the main body 14. Of course, the guard member 24 can extend slightly below the rim 30 or above the rim 30, if desired.

The main objective of the guard member 24 is to prevent objects positioned within the wall 34 from dropping into the opening 16. The guard member 24 prevents food items positioned in a "cup" formed by the main body 14 from sliding into the central opening 16, while the users pick up items deposited into the cover 10.

The main body 14 has a continuous sidewall 34 secured to the bottom plate 26 that in combination form a food receptacle of generally cup-shaped configuration. The wall 34 can be concave, as shown in FIG. 1 to form a "cup" receptacle for food items. Of course, other configurations of the main body wall can be used, such as cylindrical, conical, oval, hemispherical, in the shape of an inverted pyramid, and the like. Many other variations will be apparent to persons skilled in the art.

In additional aspects of the present invention, the bottom plate 26 has a plurality of apertures apertures 36 formed therein to provide a means through which the liquids can be drained into the waste receptacle 20, while the seafood, napkins and other objects remain positioned in the "cup" of the main body 14. The apertures 36 can be elongated slits, as shown in the drawings, or round holes, or any other types of apertures.

The rim 30 defines a generally planar top surface 40, which can serve as a support for cups, eating utensils, napkins, condiments and other incidental objects. If desired, the top planar surface 40 can be provided with a plurality of indentations 42 that can receive glasses, while stabilizing the glasses on the top surface 40.

Figure 3:
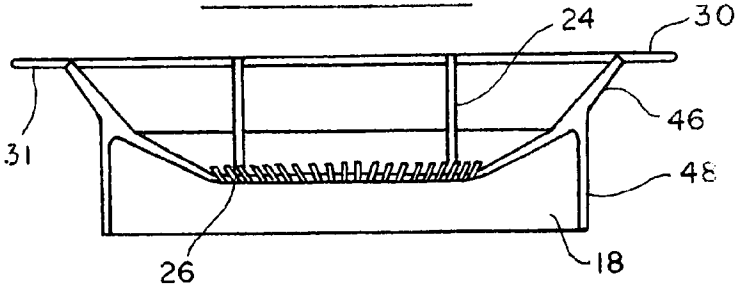
FIG. 3 is a sectional view of the cover device of the present invention.
Figure 6:
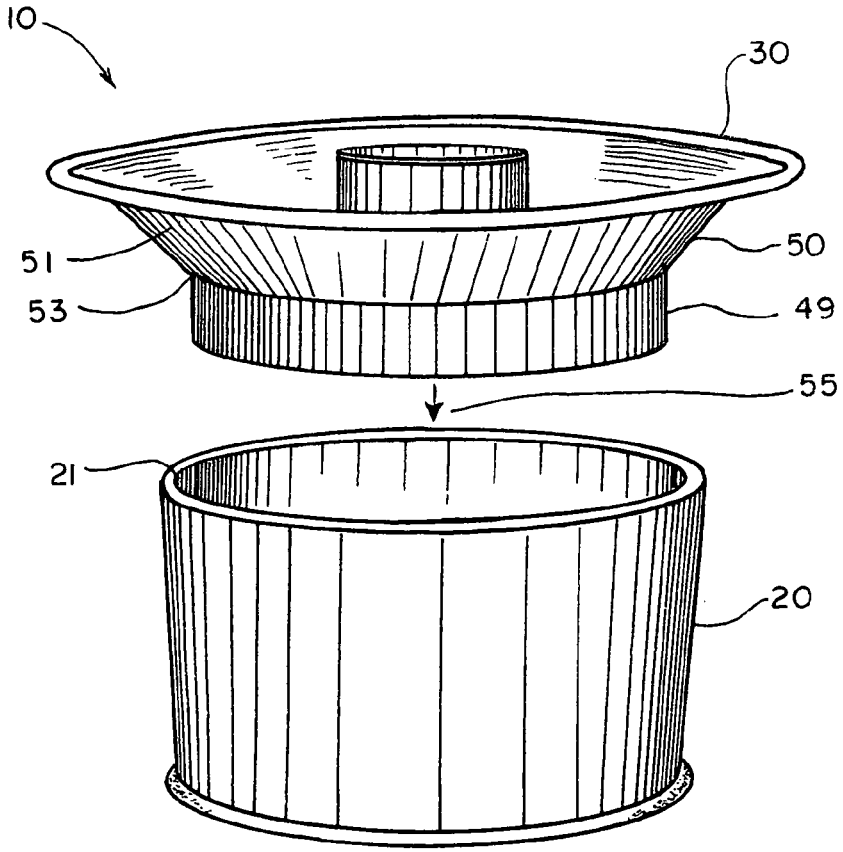
FIG. 6 is a perspective view of the cover device of the present invention about to be engaged with a waste receptacle.

The rim 30 can be formed with peripheral dimensions greater than those of the support 12, as shown in FIGS. 1, 3, and 6, allowing more space between the users and the trash receptacle 20. Alternatively, the rim 30 can be made with peripheral dimensions substantially equal to the outer dimensions of the support member 12, allowing the outer surface 46 of the main body 14 to wedge itself against the interior wall of the waste receptacle 20.

In one aspect, the outer wall 48 (FIG. 3) of the main body 14 can be made cylindrical, in which case the bottom surface 31 of the rim 30 serves as a means for supporting the device 10 over the waste receptacle 20.

The main body 14 can be made detachable from the support 12, allowing the device 10 to be easily disassembled, washed and stored. If desired, the main body 14 can be formed with a unitary support 12 that is secured to the exterior wall of the main body 14. In FIG. 6, the support member is designated by numeral 49. In this embodiment, the support member 49 is configured as a detachable member that can be separated from the main body 50. In this embodiment, the conical wall 51 fits into the ring-shaped support member 49 and rests on a top edge 53 of the support member 49.

In operation, a user positions the main body in engagement with the support 12 (if the embodiment of FIG. 6 is used) and then moves the main body and the support member in the direction of arrow 55 (FIG. 6) to position the support member 12 or 49 to fit inside a waste receptacle 20. As can be seen in FIG. 6, the outer dimensions of the tubular support member are slightly smaller than the size of the open top of the waste container 20. When the user inserts the support member into the opening in the waste receptacle 20 the outer surface 46 of the peripheral wall 34 wedges against the upper edge 21 of the waste receptacle 20. The device 10 can be supported on the top edge 21 of the waste receptacle 20 by either the bottom surface 31 of the rim 30 or by the exterior wall 46 of the main body 14. The user then deposits cooked seafood into the "cup" formed by the main body 14, allowing the liquids to drain into the waste receptacle 20. The users can position cups, condiment bottles, napkins and other objects on the top surface 40 of the rim 30. Any waste generated during the meal can be thrown into the opening 16, being guided by the guide member 24.

Figure 4:
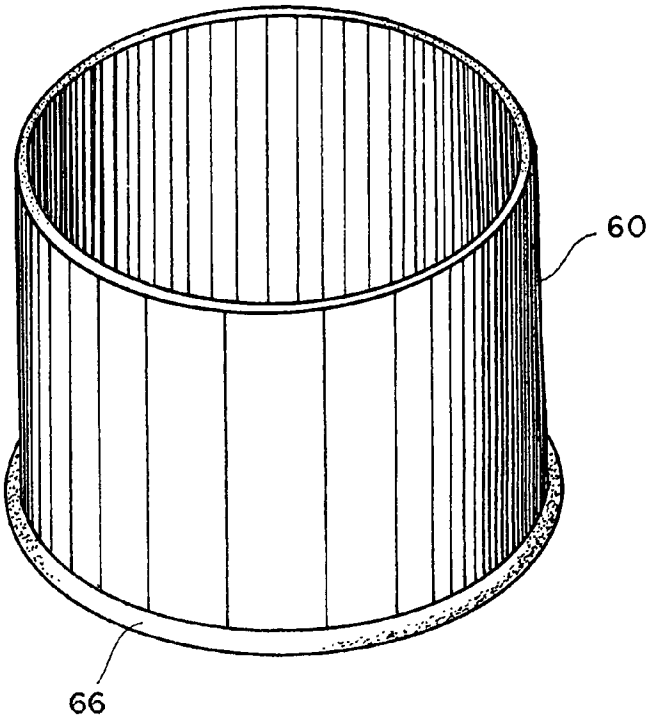
FIG. 4 is a perspective view illustrating an alternative support member of the cover device of the present invention.
Figure 2:
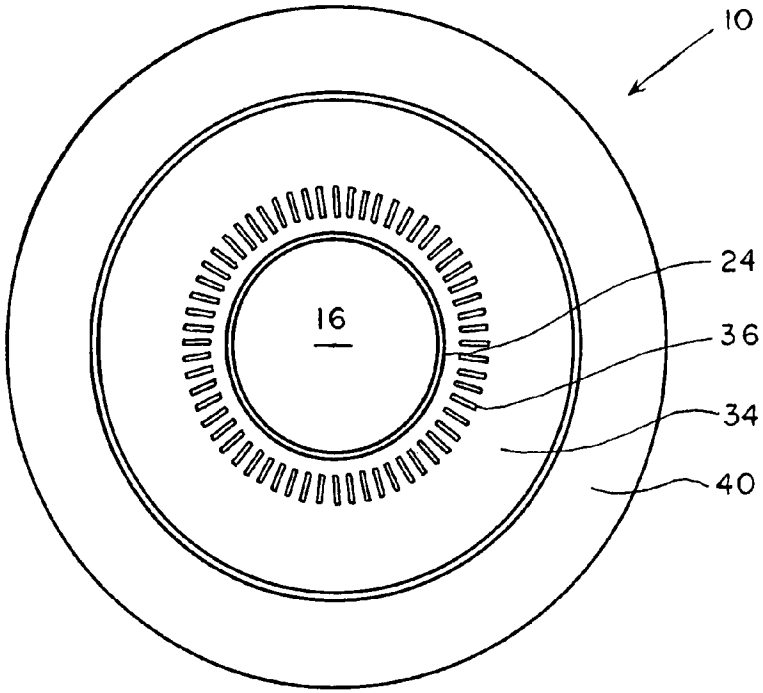
FIG. 2 is a top view of the cover device of the present invention.
Figure 5:
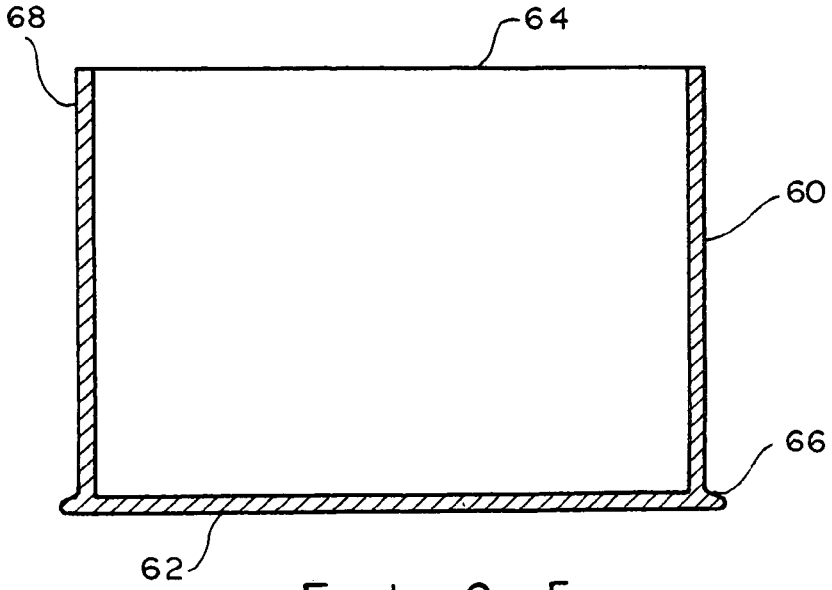
FIG. 5 is a sectional view of the alternative support member of the cover device of the present invention.

FIGS. 4 and 5 illustrate an embodiment with an optional waste receptacle 60. As can be seen in the drawings, the waste receptacle 60 has a closed bottom 62 and an open top 64. A peripheral flange 66 is formed around the bottom plate 62 to stabilize upright orientation of the receptacle 60. The flange 66 has greater dimensions that the bottom plate 62 extending outwardly from the wall 68 of the receptacle body 60. The open top 64 is configured and sized to receive the receptacle cover device 10 therein.

In operation, a user engages the receptacle cover device 10 with the receptacle 60 and deposits the cooked food items in the receptacle cover device 10. The receptacle 60 is adapted to receive and contain waste generated during meals, while the main body 14 serves as a support for the food items.

It is envisioned, that the receptacle cover device 10 can be used in food preparation and other activities where readily accessible waste disposal is required. For instance, restaurant kitchens with limited countertop space can benefit from the utilization of the receptacle cover 10, allowing the kitchen staff to clean, peel and cut food items, while disposing of the seeds, rind and the like directly into a waste receptacle, and while the cover 10 supports the food items during these tasks. Other uses can be made of the device 10, for instance in an office environment, work shop, school, etc. The receptacle cover device 10 and its components can be made of a variety of materials, including, for example, plastic, rubber, metal, wood and others.

Many changes and modifications can be made in the design of the present invention without departing from the spirit thereof. 1, therefore, pray that my rights to the present invention be limited only by the scope of the appended claims.

I claim:

1. A receptacle cover device adapted for supporting objects above an open-top waste container while facilitating disposal of waste within the waste container, the device comprising:

a generally tubular upright support member configured for fitting in the open top of the waste container; and a cup-shaped main body configured for engagement with the support member while extending upwardly therefrom, said main body being configured for substantially covering said open top of the waste container, said main body comprising a bottom with a central opening for providing access to the interior of the waste container, a plurality of spaced liquid drain openings formed in the bottom a distance from the central opening, and an upwardly extending guard member surrounding said central opening and extending upwardly therefrom, said guard member being configured to prevent objects supported by the main body from falling into the waste container through the central opening.

2. The device of claim 1, wherein said main body further comprises a peripheral rim with a substantially planar top surface.

3. The device of claim 2, wherein said top surface is provided with a plurality of indentations configured to support auxiliary items on the rim of the main body.

4. The device of claim 2, wherein said rim has exterior dimensions at least slightly greater than exterior dimensions of the waste container, such that a bottom surface of the rim rests on an upper edge of the waste container.

5. The device of claim 1, wherein said main body comprises a continuous sidewall secured to the bottom, said sidewall forming a stop means for preventing the cover device from moving into the waste container.

6. The device of claim 5, wherein said sidewall has a generally concave configuration.

7. The device of claim 1, wherein said main body is detachably, secured to said support member.

8. The device of claim 1, wherein said main body is unitary connected to said support member.

9. The device of claim 1, further comprising a closed bottom waste receptacle for positioning of the receptacle cover thereon.

10. The device of claim 9, wherein said closed bottom waste receptacle is provided with an enlarged peripheral flange for increasing stability of the waste receptacle.

11. A method of holding objects above an open-top receptacle while facilitating disposal of waste into said receptacle, comprising the steps:

providing a receptacle cover structure comprising a generally tubular upright support member and a cup-shaped main body engageable with the support member for substantially covering said open top of the waste receptacle, said main body comprising a bottom with a central opening, a plurality of spaced liquid drain openings formed in the bottom a distance from the central opening, and an upwardly extending guard member mounted in a surrounding relationship to the central opening;

positioning said receptacle cover structure over said receptacle and engaging said receptacle cover structure with the open top of the receptacle;

depositing objects into the receptacle cover structure, while forming a barrier with said guard member and preventing the objects from dropping into the receptacle and while allowing liquids to drain through said liquid drain openings into the receptacle; and disposing of waste through said central opening.

12. The method of claim 11, wherein said main body further comprises a peripheral rim with a substantially planar top surface configured for positioning of auxiliary objects thereon.

13. The method of claim 12, wherein said top surface is provided with a plurality of indentations configured to support auxiliary items therein.

14. The method of claim 12, wherein said rim has exterior dimensions at least slightly greater than exterior dimensions of the waste receptacle, such that a bottom surface of the rim rests on an upper edge of the waste receptacle.

15. The method of claim 11, wherein said main body comprises a continuous sidewall secured to the bottom, said sidewall forming a stop means for preventing the cover device from moving into the waste receptacle.

16. The method of claim 15, wherein said sidewall has a generally concave configuration.

17. The method of claim 11, further comprising a step of detachably securing said main body to said support member.

18. The method of claim 11, further comprising a step of unitary securing said main body to said support member.

19. The method of claim 11, further comprising a step of providing closed bottom waste receptacle configured for engagement with the support member and positioning of the receptacle cover structure thereon.

* * * * *